US006056255A

United States Patent [19]

Meade

[11] Patent Number: 6,056,255

[45] Date of Patent: May 2, 2000

[54] HANGING TORCH STAND

[76] Inventor: Alta G. Meade, 11 Lineback Rd., Florence, Ind. 47020

[21] Appl. No.: 09/078,890

[22] Filed: May 14, 1998

[51] Int. Cl.[7] ..... A47K 1/08

[52] U.S. Cl. ..... 248/313; 211/85.18

[58] Field of Search ..... 248/230.1, 80, 248/81, 83, 313, 346.02, 346.03, 346.06, 213.2, 539; 211/71.01, 72, 85.18, 205, 70.05

[56] References Cited

U.S. PATENT DOCUMENTS

| | | | |
|---|---|---|---|
| 616,555 | 12/1898 | Paddock | 211/62 |
| 2,313,868 | 3/1943 | Garlinghouse | 280/53 |
| 3,065,857 | 11/1962 | Sanders | 211/85.19 |
| 3,791,403 | 2/1974 | Folkerth | 248/313 X |
| 4,168,007 | 9/1979 | Rohatensky | 211/71 |
| 4,621,737 | 11/1986 | Casey | 211/70.05 |
| 4,625,949 | 12/1986 | Walker | 266/48 |
| 5,025,935 | 6/1991 | Hadacheck | 211/71 |
| 5,100,007 | 3/1992 | Espasandin et al. | 211/71 |
| 5,176,265 | 1/1993 | Bennett | 211/71 |
| 5,340,136 | 8/1994 | MacNeil et al. | 280/472 |
| 5,431,422 | 7/1995 | Gamache | 280/47.19 |

*Primary Examiner*—Ramon O. Ramirez
*Assistant Examiner*—Tan Le
*Attorney, Agent, or Firm*—Henderson & Sturm LLP

[57] ABSTRACT

A torch stand 10 for storing, using, and transporting compressed gas cylinders 100 and their associated hoses 102 and torches 101 wherein the stand 10 comprises a compartmented base member 20 provided with a vertical support rod member 30 equipped with both a multi-armed stabilizing member 40 and a cap member 50 provided with a lifting ring 51.

7 Claims, 1 Drawing Sheet

HANGING TORCH STAND

BACKGROUND OF THE INVENTION

1. Field of the Invention

The present invention relates to the field of specialized supports in general, and in particular to a support for maintaining a plurality of torch equipped cylinders in an upright position.

2. Description of Related Art

As can be seen by reference to the following U.S. Pat. Nos. 2,313,868; 4,625,949; 5,340,136; and 5,431,422, the prior art is replete with myriad and diverse compressed gas cylinder transport devices.

While all of the aforementioned prior art constructions are more than adequate for the basic purpose and function for which they have been specifically designed, they are uniformly deficient with respect to their failure to provide a simple, efficient, and practical way to deploy compressed gas cylinders on-site in a safe and stable manner.

As anyone who has worked with acetylene torches is all too well aware, the transport, storage, and usage of these devices on-site is very cumbersome due to the bulk and weight of the compressed gas cylinders and the difficulty of not only transporting them around the job site, but also in storing them in a secure position such as suspended from a crane at night.

As a consequence of the foregoing situation, there has existed a longstanding need for a new and improved compressed gas cylinder torch stand that will support a plurality of cylinders, hoses and torches in an upright stable position during transport, storage, and use, and the provision of such a construction is a stated objective of the present invention.

BRIEF SUMMARY OF THE INVENTION

Briefly stated, the cylinder support stand that forms the basis of the present invention comprises in general, a base unit, a vertical support unit which projects upwardly from the base unit, a stabilizing unit which projects outwardly from the intermediate portion of the vertical support unit, and a hook unit disposed on the top of the vertical support rod member.

As will be explained in greater detail further on in the specification, the base unit comprises in general a compartmented base member having individual walled compartments dimensioned to receive the lower portion of a cylinder of compressed gas. The vertical support unit comprises a vertical support rod member which is centrally disposed on the base member and projects upwardly therefrom. The hook unit comprises a cap member disposed on the top of the support rod member and is further provided with a lifting ring and a plurality of hook elements.

In addition, the intermediate portion of the support rod member is provided with a cruciform shaped multi-armed stabilizing member wherein the outboard end of each of the arm elements of the stabilizing member are provided with torch receiving eyelets and at least some of the junctures of the adjacent arm elements are provided with hose retaining eyelets.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
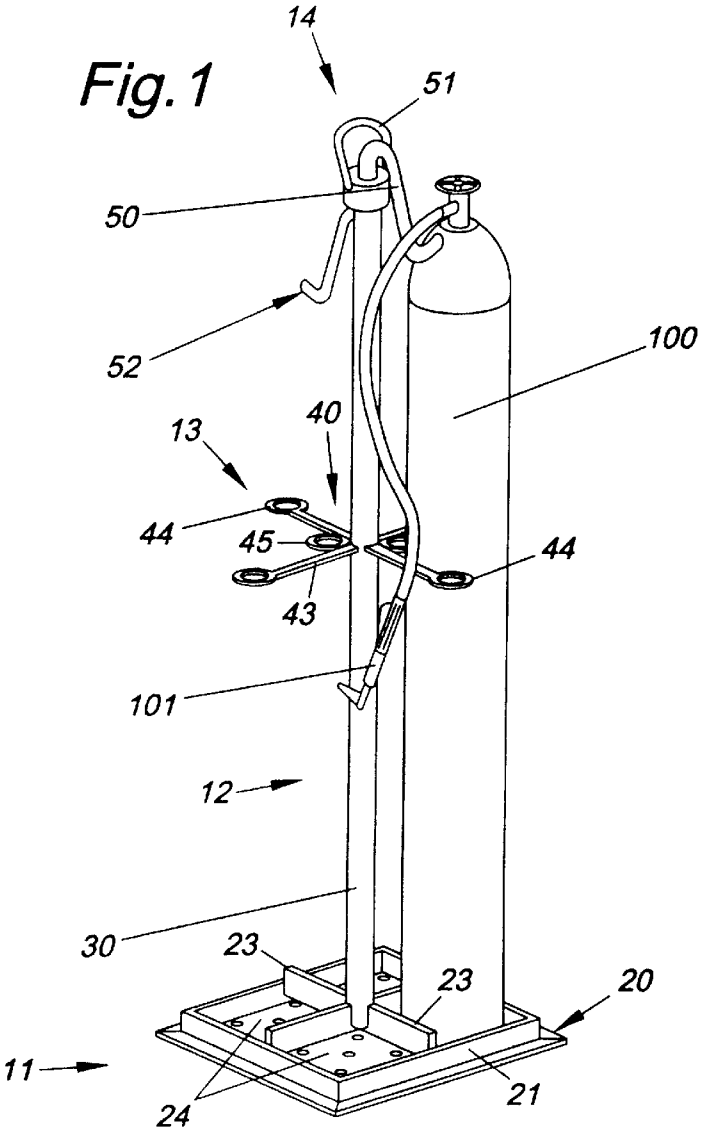
FIG. 1 is a perspective view of the hanging torch stand that forms the basis of the present invention.

As can be seen by reference to the drawings, and in particularly to FIG. 1, the hanging torch stand that forms the basis of the present invention is designated generally by the reference number 10. The stand 10 comprises in general, a base unit 11, a vertical support unit 12, a stabilizing unit 13, and a hook unit 14. These units will now be described in seriatim fashion.

As can best be seen by reference to FIG. 1, the base unit 11 comprises a generally rectangular relatively heavy base member 20 having raised side walls 21 and a plurality of bisecting interior panels 23 that divide the interior of the base member 20 into a plurality of interior compartments 24. Each compartment 24 is dimensioned to receive the lower end of a cylinder of compressed gas, such as oxygen or acetylene.

As can also be seen by reference to FIG. 1, the vertical support unit 12 comprises a vertical support rod member 30 whose lower end is secured to the base member 20 at the juncture of the interior panels 23, whose intermediate portion is equipped with the stabilizing unit 13 and whose upper end is provided with the hook unit 14.

Figure 2:
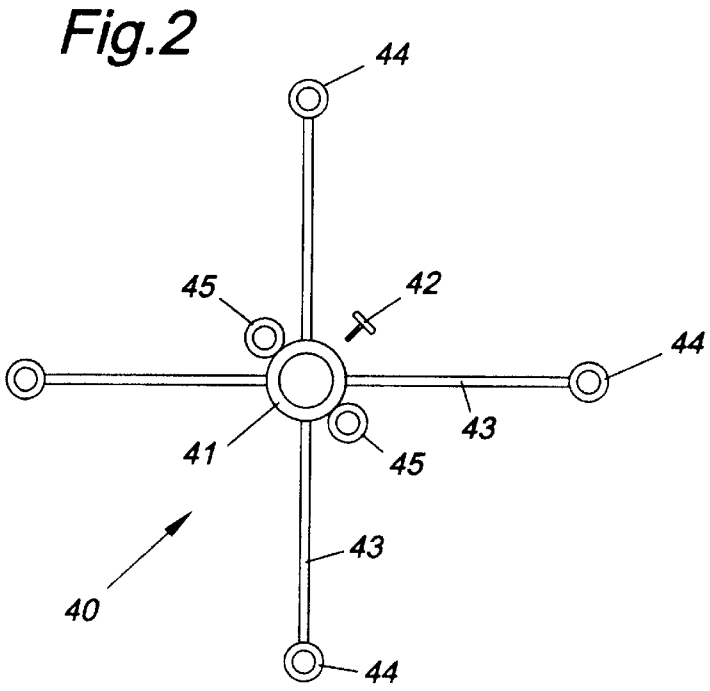
FIG. 2 is an isolated top plan view of the stabilizing unit.

Turning now to FIGS. 1 and 2, it can be seen that the stabilizing unit 13 comprises a multi armed adjustable height stabilizing member 40 having a central collar element 41 which slidably engages the vertical support rod member 30 and is provided with a plurality of securing elements 42 for locking the collar portion 41 in place at a desired height with respect to the support rod member 30 in a well recognized fashion.

In the preferred embodiment of the invention illustrated in FIG. 2, it can be seen that the stabilizing member 40 also includes a plurality of stabilizing arms 43 projecting outwardly from the collar element 41 in a generally cruciform configuration. The outboard end of each of the stabilizing arms 43 are provided with eyelets 44 dimensioned to receive a torch nozzle 101 operatively associated with one of the cylinders 100 via a gas hose 102. The juncture of at least some of the stabilizing arms 43 are provided with eyelets 45 which are dimensioned to threadedly receive the gas hoses 102.

Returning once more to FIG. 1, it can be seen that the hook unit 14 comprises a cap member 50 securely fastened to the top of the support rod member 30 and provided with an upwardly projecting lifting ring 51 and a plurality of hose hooks 52. The lifting ring 51 is provided to transport the torch stand 10 from one location to another with the gas cylinders 100 and the conventional accessories 101, 102 in place. The hose hooks 52 are provided to support the upper portions of the compressed gas hoses 102 so that they do not develop kinks either during storage or while in use on the torch stand.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

What is claimed is:

1. A torch stand for use with a plurality of compressed gas cylinders having gas hoses equipped with torch nozzles wherein the torch stand comprises:

a base unit including a generally rectangular base member having a plurality of interior compartments; wherein each compartment is dimensioned to receive the lower portion of one of the plurality of compressed gas cylinders;

a vertical support unit including a support rod member having a bottom portion, an intermediate portion, and a top portion wherein the bottom portion of the support rod member is fixedly secured to the base member; and a stabilizing unit including a multi-armed vertically adjustable stabilizing member operatively associated with the intermediate portion of the support rod member wherein the stabilizing member is provided with a plurality of outwardly projecting stabilizing arms having outboard and inboard ends wherein the outboard ends of at least some of the stabilizing arms are provided with eyelets adapted to receive a torch nozzle; and wherein the inboard ends of at least some of the stabilizing arms are provided with eyelets that are adapted to threadably receive a gas hose.

2. The torch stand as in claim 1 wherein the support rod member is centrally disposed on the base member.

3. The torch stand as in claim 2 further comprising:

a hook unit including a cap member fixedly secured to the upper portion of the support rod member and provided with an upwardly projecting lifting ring.

4. The torch stand as in claim 2 wherein the cap member is further provided with a plurality of hose hooks.

5. The torch stand as in claim 1 further including means associated with the upper portion of the support rod member for lifting up the torch stand.

6. The torch stand as in claim 1 wherein the stabilizing member comprises a collar element dimensioned to be slidably received on the intermediate portion of the support rod member.

7. The torch stand as in claim 6 wherein the collar element is provided with securing elements for fixedly securing the collar element relative to the support rod member.

* * * * *